US006870309B2

(12) United States Patent
Blyablin et al.

(10) Patent No.: US 6,870,309 B2
(45) Date of Patent: Mar. 22, 2005

(54) COLD EMISSION FILM CATHODE AND FLAT PANEL DISPLAY WITH NANOCRYSTALLINE CARBON FILM EMITTER

(75) Inventors: Alexandr Alexandrovich Blyablin, Moscow (RU); Alexandr Tursunovich Rakhimov, Moscow (RU); Vladimir Anatolievich Samorodov, Moskovskaya Obl. (RU); Nikolai Vladislavovich Suetin, Elektrostal (RU); Mikhail Arkadievich Timofeev, Moscow (RU)

(73) Assignee: Obschestvo S Organichennoi Otvetstvennostiju "Vysokie Tekhnologii", Moscow (RU)

( * ) Notice: Subject to any disclaimer, the term of this patent is extended or adjusted under 35 U.S.C. 154(b) by 0 days.

(21) Appl. No.: 10/332,827

(22) PCT Filed: Jul. 12, 2001

(86) PCT No.: PCT/RU01/00282

§ 371 (c)(1),
(2), (4) Date: May 14, 2003

(87) PCT Pub. No.: WO02/05304

PCT Pub. Date: Jan. 17, 2002

(65) Prior Publication Data

US 2003/0173885 A1 Sep. 18, 2003

(30) Foreign Application Priority Data

Jul. 12, 2000 (RU) ..... 2000118182

(51) Int. Cl.[7] ..... H01J 1/05; H01J 1/14; H01J 1/62; H01J 17/04; H01J 61/04

(52) U.S. Cl. ..... 313/310; 313/501; 313/631; 313/632; 313/633; 313/311; 313/345; 313/346 R

(58) Field of Search ..... 313/631–633, 313/310, 311, 345, 346 R

(56) References Cited

U.S. PATENT DOCUMENTS 5,709,577 A * 1/1998 Jin et al. ..... 445/24

(List continued on next page.)

FOREIGN PATENT DOCUMENTS

JP 9265893 10/1997

(List continued on next page.)

*Primary Examiner*—Vip Patel
*Assistant Examiner*—Matt Hodges

(57) ABSTRACT

The invention relates to flat panel display terminals based on cold emission cathodes.

The aim of said invention is to develop a full color processing display terminal using a cold emission cathode having high emission characteristics.

The inventive cold emission film cathode comprises an insulated substrate which can be made of glass and a nanocrystalline carbon film emitter placed on it, said emitter is embodied in the form of a mono layer of grains of powder of a high temperature resistive material having a grain size ranging from $10^{-9}$ to $10^{-4}$ m, said grains being covered with a nanocrystalline carbon film. The inventive flat display terminal comprises flat glass plates on one of which a system of cold emission cathodes is arranged, said cathodes are embodied in a form of busbars coated with the mono layer of grains of powder of high temperature resistive material having a grain size ranging from $10^{-9}$ to $10^{-4}$ m which are covered with a nanocrystalline carbon film. The powdery grains are made of a material belonging to the family of silicon, diamond, silicon carbide, molybdenum, tungsten, tantalum, titanium and the alloys thereof. The plates are embodied in the form of a sheet glass.

At least one grid can be arranged between cathode and the anode.

Said invention allows to use a cheap glass and even polymers to produce a cathode assembly of a display terminal, in addition to the use of standard processing for sealing and vacuuming of the display terminal.

8 Claims, 1 Drawing Sheet

U.S. PATENT DOCUMENTS

| | | | | | |
|---|---|---|---|---|---|
| 6,042,900 | A | | 3/2000 | Rakhimov et al. | 427/577 |
| 6,100,628 | A | * | 8/2000 | Coll et al. | 313/310 |
| 6,103,423 | A | * | 8/2000 | Itoh et al. | 429/231.8 |
| 6,409,567 | B1 | * | 6/2002 | Amey et al. | 445/50 |

FOREIGN PATENT DOCUMENTS

| | | |
|---|---|---|
| JP | 11154456 | 6/1999 |
| RU | 2083018 | 6/1997 |
| RU | 97107393 | 5/1999 |
| RU | 2149477 | 5/2000 |
| WO | WO 9633507 | 10/1996 |

* cited by examiner

COLD EMISSION FILM CATHODE AND FLAT PANEL DISPLAY WITH NANOCRYSTALLINE CARBON FILM EMITTER

CROSS REFERENCE TO RELATED APPLICATIONS

Applicants claim priority under 35 U.S.C. §119 of Russian Application No. 2000118182 filed Jul. 12, 2000. Applicants also claim priority under 35 U.S.C. §365 of PCT/RU01/00282 FILED Jul. 12, 2001. The international application under PCT article 21(2) was not published in English.

FIELD OF INVENTION

This invention relates to a field of highly effective cold emission cathodes and full color flat panel displays on a basis of them.

PRIOR ART

Display is known comprising a cold emission cathode which cold emission cathode is made in a form of tips of silicon, molybdenum or other conductive material [I. Brodie, P. R. Schwoebel, Proceedings of the IEEE, 1994, v.82, n.7, p.1006]. However such cathodes are very expensive and their emission characteristics are not stable.

Display is also known wherein the cold emission cathode is made in a form of a substrate and emitter on it which emitter is made of an amorphous diamond film produced by a method of laser sputtering [Diamond based field emission flat panel displays. Solid State Technol., 1995, May, p.71]. The films of amorphous diamond are produced by deposition on a cold substrate of carbon evaporated from a graphite target by high power laser. Shortcoming inherent to such films is a low density of emission centers (~$10^3$ per sq.cm at electrical field 20 V/micron) what is insufficient to create a full color monitor with 256 shade of grades. Also one can mention such shortcomings as its complexity, cost, and difficultness to scale up.

A cold emission film cathode is known made in a form of a substrate and emitter on it which emitter is made of nanocrystalline carbon (diamond) film [U.S. Pat. No. 06,042,900 of Dec. 3, 1996]. Such cathode possesses emission characteristics sufficient to create high quality full color monitor since density of the emission centers at the nanocrystalline carbon (diamond) film is more than $10^5$, emission threshold is 5–8 V/micron and current is more than 1 A/sq.cm. However, deposition technology of such films requires heating of substrates up to temperature of more than 700° C. what excludes using glass substrates.

DESCRIPTION OF THE INVENTION

The objective of the proposed invention is developing of a cold emission film cathode having high emissive properties and which is technological and non-expensive to produce. Important that it is glass which is the most cheap and technological material meeting all the requirements for sealing and vacuuming of the displays and also methods have been already developed to etch glass or apply metallization on it what allows using of glass or even polymeric substrates to create a full color display on the basis of this cathode.

In the proposed cold emission film cathode, comprising a dielectric substrate and a nanocrystalline carbon film emitter on it, said emitter is made in a form of a mono layer of grains of powder of high temperature material coated with a nanocrystalline carbon film. Powder grain size is selected within a range from $10^{-9}$ to $10^{-4}$ m.

Said powder is selected from the following materials: silicon, diamond, silicon carbide, molybdenum, tungsten, tantalum, titanium or their alloys. A metal layer can be put between the substrate and emitter.

It is proposed a flat panel display which comprises the parallel dielectric panels, a system of cold emission cathodes is placed on one of said panels in the clearance between them, which cathodes are made in the form of the parallel conductor lines and nanocrystalline carbon film emitter on them, and a system of anodes placed on the opposite said panel, wherein the emitter is made in a form of a mono layer of grains of powder of high temperature material selected from the following materials: silicon, diamond, silicon carbide, molybdenum, tungsten, tantalum, titanium or their alloys and having the grain size within a range from $10^{-9}$ to $10^{-4}$ m and coated with a nanocrystalline carbon film. And the said panels can be made in form of the glass plates. The cathodes and anodes form a system of columns and rows. The display can be made either by a diode scheme or it can comprise additional grids placed between the cathodes and anodes.

BRIEF DESCRIPTION OF DRAWINGS

Invention is illustrated by a drawing showing a design of the flat panel display made by a diode scheme on a basis of a cold emission cathode where in the FIG. 1 the cathode is schematically shown, and in the FIG. 2 a view along rows is shown, and in the FIG. 3—a view of the display is shown along columns.

Cathode is made on a substrate (1) with an emitter placed on it which emitter is made in form of a mono layer of grains (2) coated with a nanocrystalline carbon containing film (3).

Figure 1:
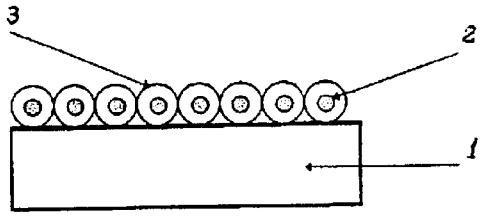
Figure 2:
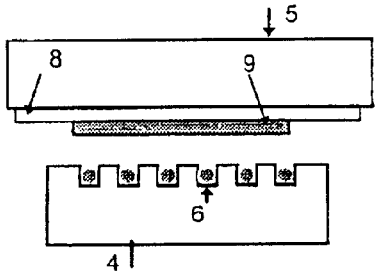
Figure 3:
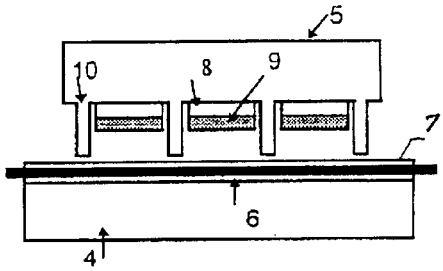

Display comprises two glass panels (4) and (5). On one of said panels (4) parallel conductor lines (6) are placed with emitters (7) located on them and working as cold emission cathodes, which emitters are made in the form of the mono layer of a powder grains coated with the nanocrystalline carbon film. On the opposite glass panel (5) a system of anodes (8) is placed which anodes are coated with a layer of phosphor (9). The distance between the cathodes and anodes is determined by a size of a spacer (10).

EXAMPLE OF THE INVENTION EMBODIMENT

When making a display by a triode scheme a grid is placed between the cathodes and anodes. Main function of this grid is controlling the emission current. The distance between the grid and the substrate surface at its lower limit is restricted by roughness of the cathode, and at its upper limit—by a magnitude of controlling voltage.

Heating of powders when depositing of the emissive film is made at the temperature within the range of 600–900° C., as follows from conditions of deposition technology of a high emission film. So the material of the powder is selected accounting a requirement of resistance to high temperatures up to about 1000° C., high adhesion of the emission film, low sputtering and chemical reactivity in flow of hydrogen and carbon containing gas. Size of the powder particles and their dispersion are determined by a minimal distance suitable between the grid and cathode and also by technological and economical performances. Obviously, that the powder particles shall be pronouncedly smaller than the distance between the grid and the cathode.

Emission characteristics of the proposed cathode have been carried out. The powder of silicon was used with particle size of less than 10 microns. The thin layer of powder was distributed along the surface of the substrate holder and deposition process was carried out. Studies by scanning electron and scanning tunneling microscopes and X-ray difractometry confirmed presence on the powder grains surface of the nanocrystalline carbon film. Thus produced powder was applied on a silicon substrate using a silver paste. Emission characteristics of thus fabricated cathode were measured in the diode tester with phosphor screen according to the standard testing procedure. From these data it follows that emission threshold is just a few volts per micron. From phosphor luminescence data it follows that electron emission is uniformly distributed along the cathode surface. Current density of more than 10 mA/sq.cm was achieved.

Applicability in Industry

The proposed device allows using of a cheap glass and even polymers to produce cathode assembly of a display employing cold emission cathode and to this using of standard technologies for sealing and vacuuming of the display.

What is claimed is:

1. Cold emission film cathode made in form of a dielectric substrate with a nanocrystalline carbon film emitter placed on it so that the emission centers density is more than $10^5$ per sq. cm, wherein said emitter is made in a form of a monolayer of grains of powder of high temperature material which grains have size within a range from $10^{-9}$ to $10^{-4}$ m and are coated with a nanocrystalline carbon film having emission centers density more than $10^5$ per sq.cm.

2. Cold emission cathode of claim 1, wherein the said powder grains are made from either silicon, diamond, silicon carbide, molybdenum, tungsten, tantalum, titanium or their alloys.

3. Cold emission cathode of claim 1, wherein the said dielectric substrate is made of glass.

4. Cold emission cathode of claim 1, wherein between the said substrate and emitter a metallic layer is placed.

5. Flat panel display comprising the parallel dielectric panels in the clearance between which a system of parallel cold emission cathodes is placed on one of said panels, which cathodes are made in a form of parallel conductor lines and having nanocraystalline carbon film emitters on them, and a system of anodes placed on the opposite said panel, wherein the emitter is made in a form of a mono layer of grains of powder of high temperature material which grains have size within a range from $10^{-9}$ to $10^{-4}$ m and are coated with a nanocrystalline carbon film having emission centers density more than $10^5$ per sq.cm.

6. Flat panel display of claim 5, wherein said panels can be made in form of the glass plates.

7. Flat panel display of claim 6, wherein said grains of powder are made from either silicon, diamond, silicon carbide, molybdenum, tungsten, tantalum, titanium or their alloys.

8. Flat panel display of claim 6, wherein between the said cathode and anode, at least one grid is placed.

* * * * *